US011830664B2

(12) United States Patent
Kato et al.

(10) Patent No.: US 11,830,664 B2
(45) Date of Patent: Nov. 28, 2023

(54) MULTILAYER COIL COMPONENT

(71) Applicant: TDK Corporation, Tokyo (JP)

(72) Inventors: Hajime Kato, Tokyo (JP); Hidekazu Sato, Tokyo (JP); Makoto Yoshino, Tokyo (JP); Kazuya Tobita, Tokyo (JP); Yuto Shiga, Tokyo (JP); Youichi Kazuta, Tokyo (JP); Noriaki Hamachi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 785 days.

(21) Appl. No.: 16/746,178

(22) Filed: Jan. 17, 2020

(65) Prior Publication Data

US 2020/0234873 A1 Jul. 23, 2020

(30) Foreign Application Priority Data

Jan. 23, 2019 (JP) ..... 2019-009391

(51) Int. Cl.

| | |
|---|---|
| ***H01F 27/29*** | (2006.01) |
| ***H01F 41/04*** | (2006.01) |
| ***H01F 27/28*** | (2006.01) |
| ***H01F 17/00*** | (2006.01) |

(52) U.S. Cl.

CPC ..... *H01F 27/292* (2013.01); *H01F 17/0013* (2013.01); *H01F 27/2804* (2013.01); *H01F 41/043* (2013.01); *H01F 2027/2809* (2013.01)

(58) Field of Classification Search

CPC ..... H01F 27/292; H01F 17/0013; H01F 27/2804; H01F 41/043; H01F 2027/2809; H01F 27/2852; H01F 27/323

See application file for complete search history.

(56) References Cited

U.S. PATENT DOCUMENTS

| | | | | |
|---|---|---|---|---|
| 8,810,350 | B2 * | 8/2014 | Seko | H01F 27/292 336/200 |
| 10,840,009 | B2 * | 11/2020 | Kido | H01F 27/292 |
| 11,133,126 | B2 * | 9/2021 | Jang | H01F 17/0013 |
| 2009/0153282 | A1 | 6/2009 | Taoka et al. | |
| 2012/0188046 | A1 * | 7/2012 | Matsuura | H01F 27/29 336/199 |
| 2013/0093558 | A1 | 4/2013 | Ono et al. | |
| 2014/0176279 | A1 * | 6/2014 | Yang | H01F 27/29 336/192 |
| 2017/0103848 | A1 | 4/2017 | Yoneda et al. | |

(Continued)

FOREIGN PATENT DOCUMENTS

| | | | | |
|---|---|---|---|---|
| JP | H09-129447 A | | 5/1997 | |
| JP | 2017005104 A | * | 1/2017 | H01F 17/0013 |

(Continued)

*Primary Examiner* — Mang Tin Bik Lian
(74) *Attorney, Agent, or Firm* — Oliff PLC

(57) ABSTRACT

A multilayer coil component 1 includes an element body 2, a coil 8, and a terminal electrode 4 and a terminal electrode 5. Each of the terminal electrode 4 and the terminal electrode 5 is disposed over at least the end surfaces 2*a* and 2*b* and a main surface 2*d*. Each of the terminal electrode 4 and the terminal electrode 5 and at least a part of the coil 8 overlap when viewed from the facing direction of the pair of side surfaces 2*e* and 2*f*. Each of the terminal electrode 4 and the terminal electrode 5 and the coil 8 do not overlap when viewed from the facing direction of the pair of end surfaces 2*a* and 2*b*.

14 Claims, 9 Drawing Sheets

(56) References Cited

U.S. PATENT DOCUMENTS

| | | | | |
|---|---|---|---|---|
| 2017/0207018 | A1* | 7/2017 | Jung | H01F 27/2804 |
| 2017/0365399 | A1* | 12/2017 | Kobayashi | H01F 27/292 |
| 2018/0137964 | A1* | 5/2018 | Tozawa | H01F 17/0013 |
| 2018/0211765 | A1* | 7/2018 | Nakaniwa | H01F 17/0033 |
| 2019/0066912 | A1* | 2/2019 | Takeda | H01F 27/323 |
| 2019/0304655 | A1* | 10/2019 | Hirukawa | H01F 27/2804 |
| 2019/0304656 | A1* | 10/2019 | Hirukawa | H01F 27/2804 |
| 2019/0304667 | A1* | 10/2019 | Hirukawa | H01F 27/292 |
| 2020/0373066 | A1* | 11/2020 | Hirukawa | H01F 27/2804 |

FOREIGN PATENT DOCUMENTS

| | | | |
|---|---|---|---|
| JP | 2017-073536 | A | 4/2017 |
| WO | 2007/055303 | A1 | 5/2007 |
| WO | 2011/155241 | A1 | 12/2011 |
| WO | 2012/086397 | A1 | 6/2012 |

* cited by examiner

MULTILAYER COIL COMPONENT

TECHNICAL FIELD

One aspect of the present invention relates to a multilayer coil component.

BACKGROUND

The multilayer coil component described in, for example, Patent Literature 1 (Japanese Unexamined Patent Publication No. 2017-73536) is known as a multilayer coil component according to the related art. The multilayer coil component described in Patent Literature 1 is provided with an element body, a coil disposed in the element body, and a pair of terminal electrodes embedded in the element body and disposed over a mounting surface and an end surface of the element body.

SUMMARY

The multilayer coil component can be reduced in size in a configuration in which the terminal electrode is embedded in the element body as in the multilayer coil component according to the related art. However, when the terminal electrode is disposed in the element body, the region in the element body decreases, and thus the inner diameter of the coil cannot be increased. In addition, an increase in the inner diameter of the coil results in a decrease in the distance between the terminal electrode and the coil in the multilayer coil component according to the related art. Then, problems arise as the stray capacitance (parasitic capacitance) formed by the coil and the terminal electrode increases and characteristics deteriorate.

An object of one aspect of the present invention is to provide a multilayer coil component in which characteristics can be improved.

A multilayer coil component according to one aspect of the present invention includes an element body formed by a plurality of insulator layers being stacked and including a pair of end surfaces facing each other, a pair of main surfaces facing each other, and a pair of side surfaces facing each other, one of the main surfaces being a mounting surface, a coil disposed in the element body and having a coil axis extending along a facing direction of the pair of side surfaces, and a first terminal electrode and a second terminal electrode disposed apart from each other in a facing direction of the pair of end surfaces and embedded in the element body. Each of the first terminal electrode and the second terminal electrode is disposed over at least the end surface and the mounting surface. Each of the first terminal electrode and the second terminal electrode and at least a part of the coil overlap when viewed from the facing direction of the pair of side surfaces. Each of the first terminal electrode and the second terminal electrode and the coil do not overlap when viewed from the facing direction of the pair of end surfaces.

In the multilayer coil component according to one aspect of the present invention, the first terminal electrode and the second terminal electrode are embedded in the element body. Accordingly, the first terminal electrode and the second terminal electrode fit within the outer shape of the element body and do not protrude from the outer surface of the element body. Accordingly, the multilayer coil component can be reduced in size. In this configuration, in the multilayer coil component, each of the first terminal electrode and the second terminal electrode and at least a part of the coil overlap when viewed from the facing direction of the pair of side surfaces. As a result, in the multilayer coil component, the inner diameter of the coil can be increased, and thus the Q value can be improved. Accordingly, characteristics can be improved in the multilayer coil component. In addition, in the multilayer coil component, each of the first terminal electrode and the second terminal electrode and the coil do not overlap when viewed from the facing direction of the pair of end surfaces. As a result, in the multilayer coil component, the stray capacitance that is generated between each of the first terminal electrode and the second terminal electrode and the coil can be reduced. As a result, characteristics can be improved in the multilayer coil component.

In one embodiment, each of the first terminal electrode and the second terminal electrode may include a first electrode part disposed on the mounting surface and a second electrode part and a third electrode part disposed on the end surface and disposed apart from each other in the facing direction of the pair of side surfaces. In this configuration, solder is formed at the first electrode part, the second electrode part, and the third electrode part when the multilayer coil component is mounted on, for example, a circuit board. Accordingly, the multilayer coil component and the circuit board can be firmly fixed. In addition, since the solder is formed at the second electrode part and the third electrode part, it can be visually confirmed that the solder is reliably formed.

In one embodiment, one end portion of the coil may be connected to the first electrode part in the first terminal electrode and the other end portion of the coil may be connected to the first electrode part in the second terminal electrode. The element body where the coil having the coil axis extending along the facing direction of the pair of side surfaces is disposed is configured by the plurality of insulator layers where coil conductors are formed being stacked in the facing direction of the pair of side surfaces. In this configuration, the coil has end portions respectively connected to the first electrode parts of the terminal electrodes. In other words, in the multilayer coil component, the coil conductor and a connection conductor interconnecting the terminal electrode and the coil are formed in the same insulator layer. Accordingly, in the multilayer coil component, it is possible to prevent disconnection between each terminal electrode and the coil even in the case of peeling of the insulator layer, and thus it is possible to maintain electrical connection between each terminal electrode and the coil.

In one embodiment, the second electrode part may be disposed over the end surface and one of the side surfaces and the third electrode part may be disposed over the end surface and the other side surface. In this configuration, it is possible to increase the distance between the second electrode part and the third electrode part in the facing direction of the pair of side surfaces. As a result, in the multilayer coil component, a region in the element body can be ensured, and thus it is possible to increase the number of turns of the coil while maintaining the size of the element body (multilayer coil component). Accordingly, characteristics can be improved in the multilayer coil component.

In one embodiment, each of the second electrode part and the third electrode part may be provided with a protruding portion protruding from each of inner surfaces in the element body facing each other in the facing direction of the pair of side surfaces. In this configuration, the second and third electrode parts and the element body can be firmly fixed. Accordingly, peeling of the first terminal electrode and the second terminal electrode from the element body can be suppressed. Accordingly, reliability can be improved in the multilayer coil component.

In one embodiment, each of the first terminal electrode and the second terminal electrode may not overlap a region inside an inner edge of the coil when viewed from the facing direction of the pair of side surfaces. In this configuration, it is possible to suppress the magnetic flux flow of the coil being hindered by the first terminal electrode and the second terminal electrode. Accordingly, a deterioration in characteristics can be suppressed in the multilayer coil component.

Characteristics can be improved according to one aspect of the present invention.

DETAILED DESCRIPTION

Figure 1:
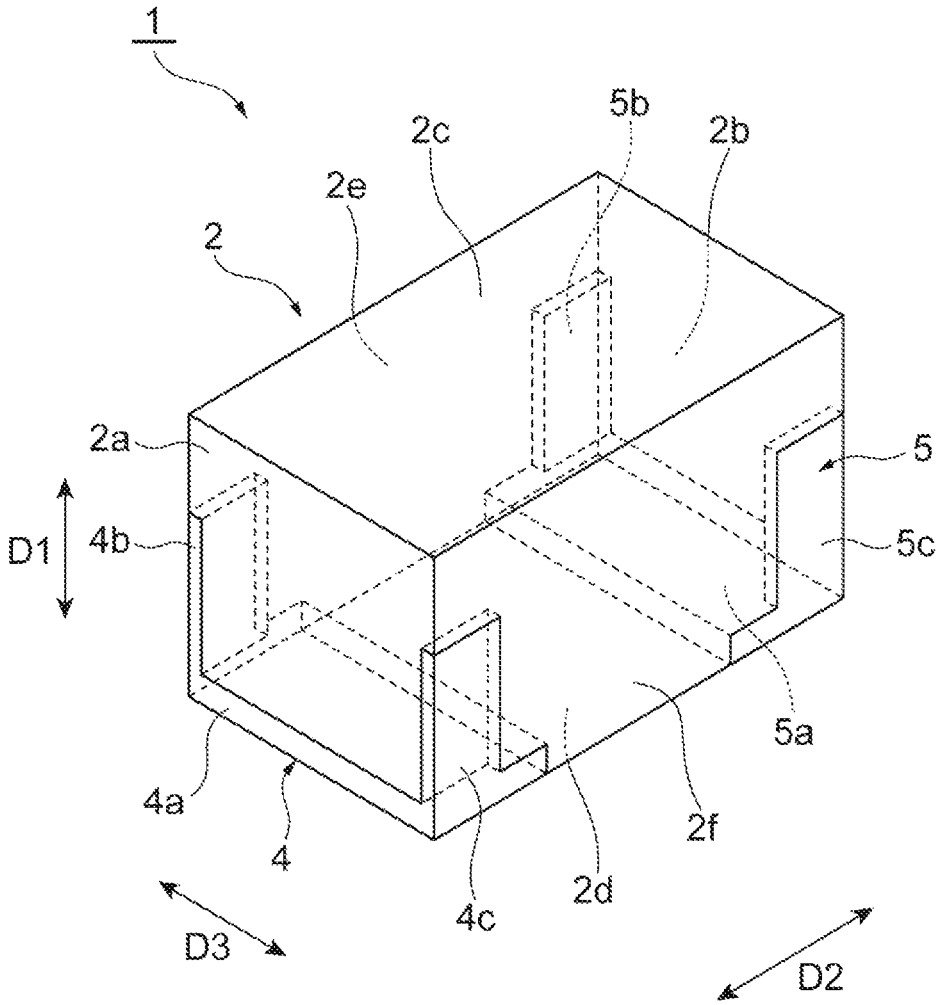
FIG. 1 is a perspective view illustrating a multilayer coil component according to a first embodiment.

Hereinafter, preferred embodiments of the present invention will be described in detail with reference to the accompanying drawings. In the description of the drawings, the same or equivalent elements will be denoted by the same reference numerals, and redundant description will be omitted.

First Embodiment

As illustrated in FIG. 1, a multilayer coil component 1 is provided with an element body 2 having a rectangular parallelepiped shape and a pair of terminal electrodes 4 and 5. The pair of terminal electrodes 4 and 5 are respectively disposed in both end portions of the element body 2. The rectangular parallelepiped shape includes a rectangular parallelepiped shape in which a corner portion and a ridge line portion are chamfered and a rectangular parallelepiped shape in which a corner portion and a ridge line portion are rounded.

The element body 2 has a pair of end surfaces 2*a* and 2*b* facing each other, a pair of main surfaces 2*c* and 2*d* facing each other, and a pair of side surfaces 2*e* and 2*f* facing each other. The facing direction in which the pair of main surfaces 2*c* and 2*d* face each other, that is, the direction that is parallel to the end surfaces 2*a* and 2*b* is a first direction D1. The facing direction in which the pair of end surfaces 2*a* and 2*b* face each other, that is, the direction that is parallel to the main surfaces 2*c* and 2*d* is a second direction D2. The facing direction in which the pair of side surfaces 2*e* and 2*f* face each other is a third direction D3. In the present embodiment, the first direction D1 is the height direction of the element body 2. The second direction D2 is the longitudinal direction of the element body 2 and is orthogonal to the first direction D1. The third direction D3 is the width direction of the element body 2 and is orthogonal to the first direction D1 and the second direction D2.

The pair of end surfaces 2*a* and 2*b* extend in the first direction D1 so as to interconnect the pair of main surfaces 2*c* and 2*d*. The pair of end surfaces 2*a* and 2*b* also extend in the third direction D3, that is, the short side direction of the pair of main surfaces 2*c* and 2*d*. The pair of side surfaces 2*e* and 2*f* extend in the first direction D1 so as to interconnect the pair of main surfaces 2*c* and 2*d*. The pair of side surfaces 2*e* and 2*f* also extend in the second direction D2, that is, the long side direction of the pair of end surfaces 2*a* and 2*b*. The multilayer coil component 1 is, for example, solder-mounted on an electronic device (such as a circuit board and an electronic component). In the multilayer coil component 1, the main surface 2*d* constitutes a mounting surface facing the electronic device.

Figure 2:
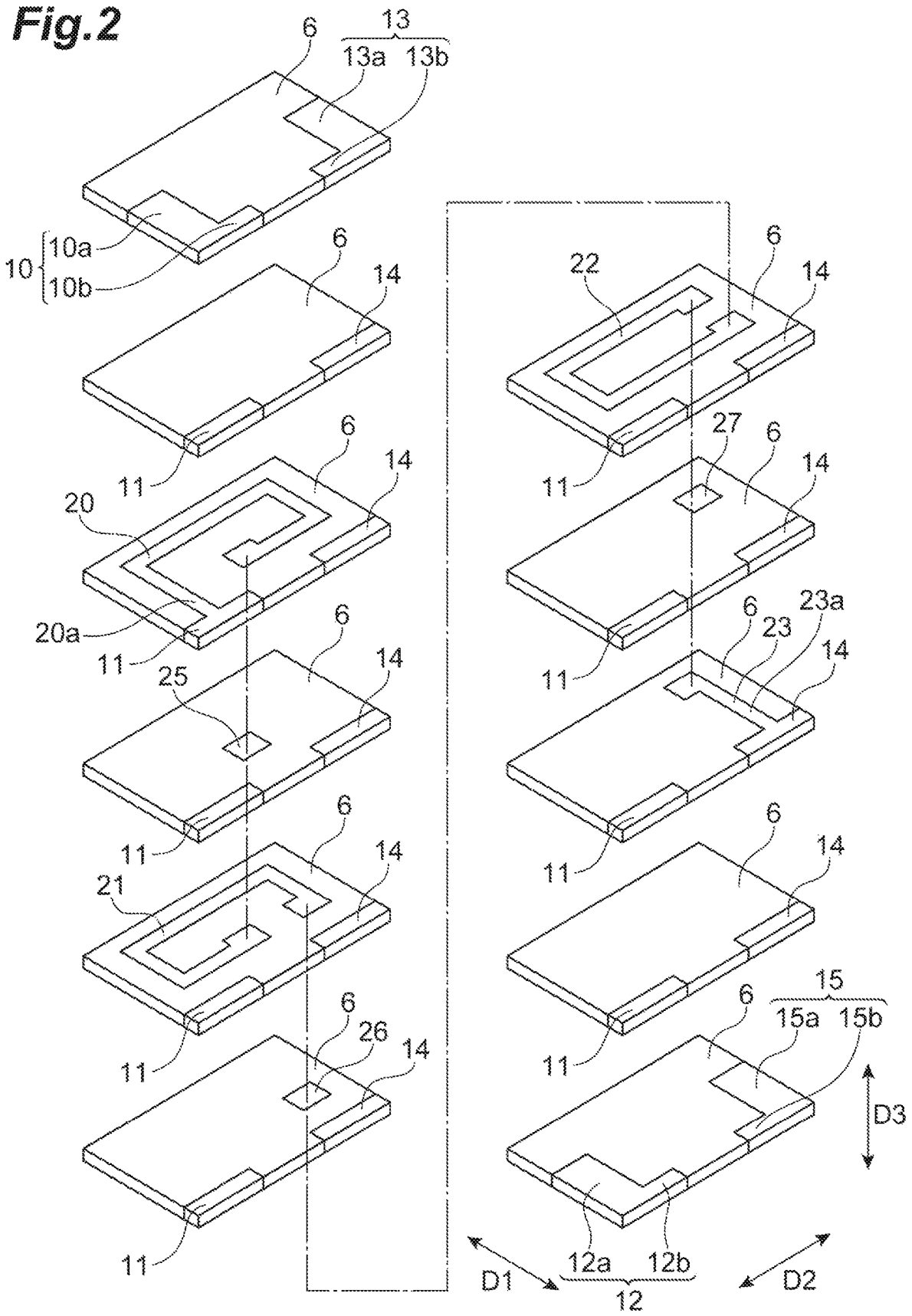
FIG. 2 is an exploded perspective view illustrating the configuration of an element body and a coil conductor of the multilayer coil component illustrated in FIG. 1.

As illustrated in FIG. 2, the element body 2 is configured by a plurality of insulator layers 6 being stacked in the third direction D3. The element body 2 has the plurality of insulator layers 6 that are stacked. In the element body 2, the direction in which the plurality of insulator layers 6 are stacked coincides with the third direction D3. In the actual element body 2, each insulator layer 6 is integrated to the extent that the boundaries between the insulator layers 6 are invisible. Each insulator layer 6 is made of, for example, a magnetic material. Examples of the magnetic material include a Ni—Cu—Zn-based ferrite material, a Ni—Cu—Zn—Mg-based ferrite material, and a Ni—Cu-based ferrite material. The magnetic material constituting each insulator layer 6 may contain a Fe alloy. Each insulator layer 6 may be made of a nonmagnetic material. Examples of the nonmagnetic material include a glass ceramic material and a dielectric material. In the present embodiment, a sintered body of a green sheet containing a magnetic material constitutes each insulator layer 6.

The terminal electrode (first terminal electrode) 4 is disposed on the end surface 2*a* side of the element body 2. The terminal electrode (second terminal electrode) 5 is disposed on the end surface 2*b* side of the element body 2. The pair of terminal electrodes 4 and 5 are separated from each other in the second direction D2. Each of the terminal electrodes 4 and 5 is embedded in the element body 2. Each of the terminal electrodes 4 and 5 is disposed in a recessed portion formed in the element body 2. The terminal electrode 4 is disposed over the end surface 2*a*, the main surface 2*d*, and the side surfaces 2*e* and 2*f*. The terminal electrode 5 is disposed over the end surface 2*b*, the main surface 2*d*, and the side surfaces 2*e* and 2*f*. In the present embodiment, the surface of the terminal electrode 4 is substantially flush with each of the end surface 2*a*, the main surface 2*d*, and the side surfaces 2*e* and 2*f*. The surface of the terminal electrode 5 is substantially flush with each of the end surface 2*b*, the main surface 2*d*, and the side surfaces 2*e* and 2*f*.

Each of the terminal electrodes 4 and 5 contains a conductive material. The conductive material contains, for example, Ag or Pd. Each of the terminal electrodes 4 and 5 is configured as a sintered body of conductive paste containing conductive material powder. Examples of the conductive material powder include Ag powder and Pd powder. A plating layer may be formed on the surface of each of the terminal electrodes 4 and 5. The plating layer is formed by, for example, electroplating or electroless plating. The plating layer contains, for example, Ni, Sn, or Au.

The terminal electrode 4 has a first electrode part 4*a*, a second electrode part 4*b*, and a third electrode part 4*c*. The first and second electrode parts 4*a* and 4*b* and the first and third electrode parts 4*a* and 4*c* are connected in the ridge line portion of the element body 2 and are electrically connected to each other. In the present embodiment, the first electrode part 4*a*, the second electrode part 4*b*, and the third electrode part 4*c* are integrally formed. The first electrode part 4*a* extends along the second direction D2 and extends along the third direction D3. The first electrode part 4*a* has a rectangular shape when viewed from the first direction D1. The second electrode part 4*b* and the third electrode part 4*c* extend along the first direction D1 and extend along the second direction D2. The second electrode part 4*b* and the third electrode part 4*c* have a rectangular shape when viewed from the third direction D3.

The first electrode part 4*a* is disposed over the end surface 2*a*, the main surface 2*d*, and the pair of side surfaces 2*e* and 2*f*. The second electrode part 4*b* is disposed over the end surface 2*a* and the side surface 2*e*. The third electrode part 4*c* is disposed over the end surface 2*a* and the side surface 2*f*. The terminal electrode 4 has a substantially U shape when viewed from the second direction D2. The terminal electrode 4 has an L shape when viewed from the third direction D3.

As illustrated in FIG. 2, the terminal electrode 4 is configured by a plurality of electrode layers 10, 11, and 12 being stacked. Each of the electrode layers 10, 11, and 12 is provided in a defect portion formed in the insulator layer 6 that corresponds. The electrode layers 10, 11, and 12 are formed by conductive paste positioned in a defect portion formed in a green sheet being fired. The green sheet and the conductive paste are fired at the same time. Accordingly, the electrode layers 10, 11, and 12 are obtained from the conductive paste when the insulator layer 6 is obtained from the green sheet. In the actual terminal electrode 4, each of the electrode layers 10, 11, and 12 is integrated to the extent that the boundaries between the electrode layers 10, 11, and 12 are invisible. The recessed portion of the element body 2 that is fired, in which the terminal electrode 4 is disposed, is obtained by the defect portion formed in the green sheet.

The electrode layer 10 has an L shape when viewed from the third direction D3. The electrode layer 10 has layer parts 10*a* and 10*b*. The layer part 10*a* extends along the first direction D1. The layer part 10*b* extends along the second direction D2. The electrode layer 11 has a rectangular shape when viewed from the third direction D3. The electrode layer 11 extends along the second direction D2. The electrode layer 12 has an L shape when viewed from the third direction D3. The electrode layer 12 has layer parts 12*a* and 12*b*. The layer part 12*a* extends along the first direction D1. The layer part 12*b* extends along the second direction D2.

The first electrode part 4*a* is configured by the layer part 10*a* of the electrode layer 10, the electrode layer 11, and the layer part 12*a* of the electrode layer 12 being stacked. At the first electrode part 4*a*, the layer part 10*a* of the electrode layer 10, the electrode layer 11, and the layer part 12*a* of the electrode layer 12 are integrated to the extent that the boundaries between the layer part 10*a* of the electrode layer 10, the electrode layer 11, and the layer part 12*a* of the electrode layer 12 are invisible. The layer part 12*b* of the electrode layer 12 constitutes the second electrode part 4*b*. The layer part 10*b* of the electrode layer 10 constitutes the third electrode part 4*c*.

As illustrated in FIG. 1, the terminal electrode 5 has a first electrode part 5*a*, a second electrode part 5*b*, and a third electrode part 5*c*. The first and second electrode parts 5*a* and 5*b* and the first and third electrode parts 5*a* and 5*c* are connected in the ridge line portion of the element body 2 and are electrically connected to each other. In the present embodiment, the first electrode part 5*a*, the second electrode part 5*b*, and the third electrode part 5*c* are integrally formed. The first electrode part 5*a* extends along the second direction D2 and extends along the third direction D3. The first electrode part 5*a* has a rectangular shape when viewed from the first direction D1. The second electrode part 5*b* and the third electrode part 5*c* extend along the first direction D1 and extend along the second direction D2. The second electrode part 5*b* and the third electrode part 5*c* have a rectangular shape when viewed from the third direction D3.

The first electrode part 5*a* is disposed over the end surface 2*b*, the main surface 2*d*, and the pair of side surfaces 2*e* and 2*f*. The second electrode part 5*b* is disposed over the end surface 2*a* and the side surface 2*e*. The third electrode part 5*c* is disposed over the end surface 2*b* and the side surface 2*f*. The terminal electrode 5 has a substantially U shape when viewed from the second direction D2. The terminal electrode 5 has an L shape when viewed from the third direction D3.

As illustrated in FIG. 2, the terminal electrode 5 is configured by a plurality of electrode layers 13, 14, and 15 being stacked. Each of the electrode layers 13, 14, and 15 is provided in a defect portion formed in the insulator layer 6 that corresponds. The electrode layers 13, 14, and 15 are formed by conductive paste positioned in a defect portion formed in a green sheet being fired. The green sheet and the conductive paste are fired at the same time. Accordingly, the electrode layers 13, 14, and 15 are obtained from the conductive paste when the insulator layer 6 is obtained from the green sheet. In the actual terminal electrode 4, each of the electrode layers 13, 14, and 15 is integrated to the extent that the boundaries between the electrode layers 13, 14, and 15 are invisible. The recessed portion of the element body 2 that is fired, in which the terminal electrode 5 is disposed, is obtained by the defect portion formed in the green sheet.

The electrode layer 13 has an L shape when viewed from the third direction D3. The electrode layer 13 has layer parts 13*a* and 13*b*. The layer part 13*a* extends along the first direction D1. The layer part 13*b* extends along the second direction D2. The electrode layer 14 has a rectangular shape when viewed from the third direction D3. The electrode layer 14 extends along the second direction D2. The electrode layer 15 has an L shape when viewed from the third direction D3. The electrode layer 15 has layer parts 15*a* and 15*b*. The layer part 15*a* extends along the first direction D1. The layer part 15*b* extends along the second direction D2.

The first electrode part 5*a* is configured by the layer part 13*a* of the electrode layer 13, the electrode layer 14, and the layer part 15*a* of the electrode layer 15 being stacked. At the first electrode part 5*a*, the layer part 13*a* of the electrode layer 13, the electrode layer 14, and the layer part 15*a* of the electrode layer 15 are integrated to the extent that the boundaries between the layer part 13*a* of the electrode layer 13, the electrode layer 14, and the layer part 15*a* of the electrode layer 15 are invisible. The layer part 15*b* of the electrode layer 15 constitutes the second electrode part 5*b*. The layer part 13*b* of the electrode layer 13 constitutes the third electrode part 5*c*.

Figure 3:
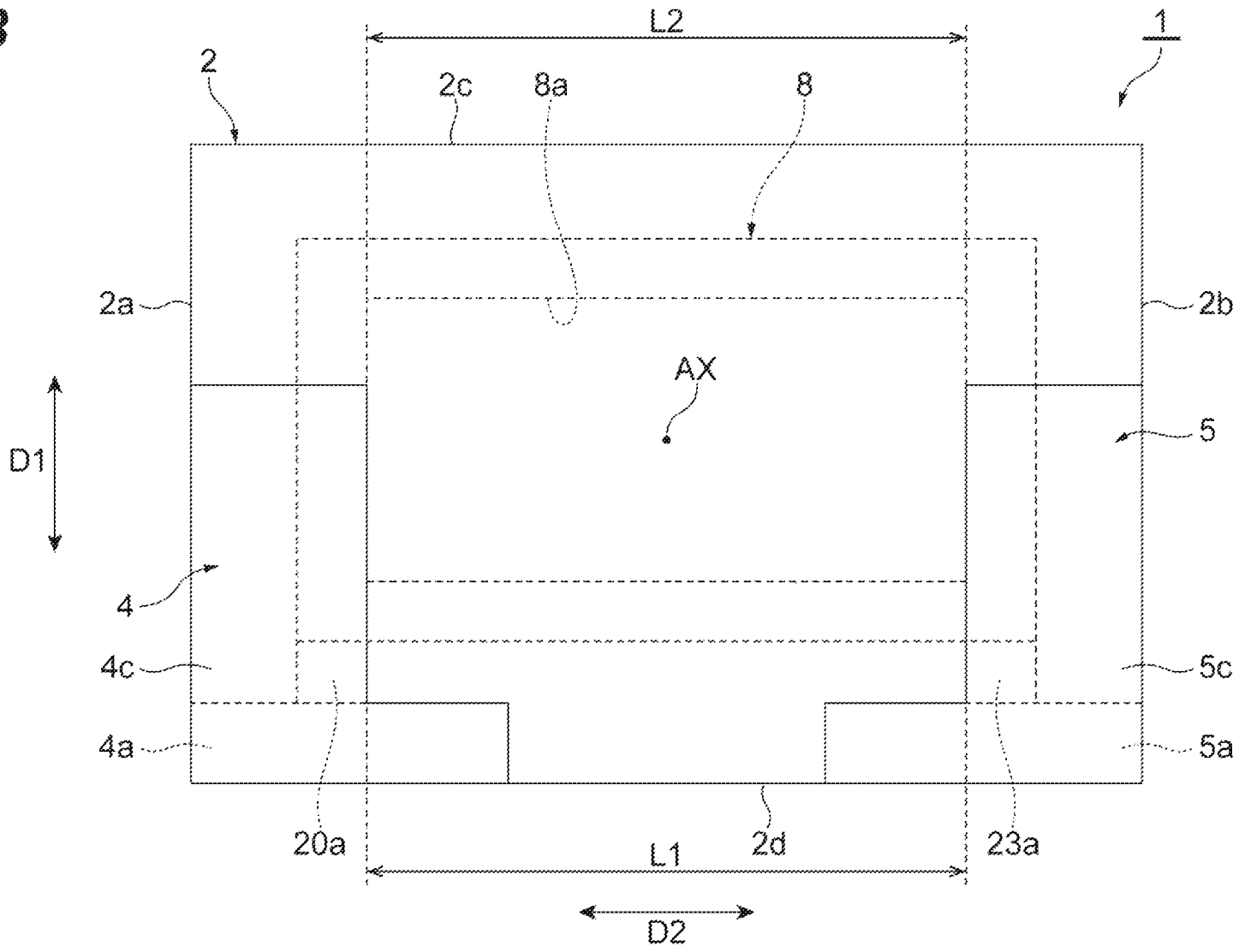
FIG. 3 is a diagram illustrating the configuration of a terminal electrode and a coil.

As illustrated in FIG. 3, the multilayer coil component 1 is provided with a coil 8 disposed in the element body 2. A coil axis AX of the coil 8 extends along the third direction D3. The coil 8 has a substantially rectangular outer shape when viewed from the direction that is along the third direction D3.

As illustrated in FIG. 2, the coil 8 has a first coil conductor 20, a second coil conductor 21, a third coil conductor 22, and a fourth coil conductor 23. The first coil conductor 20, the second coil conductor 21, the third coil conductor 22, and the fourth coil conductor 23 are disposed along the third direction D3 in the order of the first coil conductor 20, the second coil conductor 21, the third coil conductor 22, and the fourth coil conductor 23. The first coil conductor 20, the second coil conductor 21, the third coil conductor 22, and the fourth coil conductor 23 substantially have a shape in which a part of a loop is interrupted and have one end and the other end. The first coil conductor 20, the second coil conductor 21, the third coil conductor 22, and the fourth coil conductor 23 have a part linearly extending along the first direction D1 and a part linearly extending along the second direction D2. The first coil conductor 20, the second coil conductor 21, the third coil conductor 22, and the fourth coil conductor 23 have a predetermined width.

The coil 8 has a first connection conductor 25, a second connection conductor 26, and a third connection conductor 27. The first connection conductor 25, the second connection conductor 26, and the third connection conductor 27 are disposed along the third direction D3 in the order of the first connection conductor 25, the second connection conductor 26, and the third connection conductor 27. The first connection conductor 25, the second connection conductor 26, and the third connection conductor 27 have a rectangular shape.

The first coil conductor 20 is positioned in the same layer as one electrode layer 11 and one electrode layer 14. The first coil conductor 20 is connected to the electrode layer 11 via a connecting conductor 20*a*. The connecting conductor 20*a* is positioned in the same layer as the first coil conductor 20. One end of the first coil conductor 20 is connected to the connecting conductor 20*a*. The connecting conductor 20*a* is connected to the electrode layer 11. The connecting conductor 20*a* interconnects the first coil conductor 20 and the electrode layer 11. The first coil conductor 20 is separated from the electrode layer 14 positioned in the same layer. In the present embodiment, the first coil conductor 20, the connecting conductor 20*a*, and the electrode layer 11 are integrally formed.

The first connection conductor 25 is disposed in the insulator layer 6 between the first coil conductor 20 and the second coil conductor 21. One electrode layer 11 and one electrode layer 14 are positioned in the insulator layer 6 where the first connection conductor 25 is disposed. The first connection conductor 25 is separated from the electrode layers 11 and 14 positioned in the same layer. The first connection conductor 25 is connected to the other end of the first coil conductor 20 and is connected to one end of the second coil conductor 21. The first connection conductor 25 interconnects the first coil conductor 20 and the second coil conductor 21.

The second coil conductor 21 is positioned in the same layer as one electrode layer 11 and one electrode layer 14. The second coil conductor 21 is separated from the electrode layers 11 and 14 positioned in the same layer. The first coil conductor 20 and the second coil conductor 21 are adjacent to each other in the third direction D3 in a state where the insulator layer 6 is interposed between the first coil conductor 20 and the second coil conductor 21. The other end of the first coil conductor 20 and one end of the second coil conductor 21 overlap when viewed from the third direction D3.

The second connection conductor 26 is disposed in the insulator layer 6 between the second coil conductor 21 and the third coil conductor 22. One electrode layer 11 and one electrode layer 14 are positioned in the insulator layer 6 where the second connection conductor 26 is disposed. The second connection conductor 26 is separated from the electrode layers 11 and 14 positioned in the same layer. The second connection conductor 26 is connected to the other end of the second coil conductor 21 and is connected to one end of the third coil conductor 22. The second connection conductor 26 interconnects the second coil conductor 21 and the third coil conductor 22.

The third coil conductor 22 is positioned in the same layer as one electrode layer 11 and one electrode layer 14. The third coil conductor 22 is separated from the electrode layers 11 and 14 positioned in the same layer. The second coil conductor 21 and the third coil conductor 22 are adjacent to each other in the third direction D3 in a state where the insulator layer 6 is interposed between the second coil conductor 21 and the third coil conductor 22. The other end of the second coil conductor 21 and one end of the third coil conductor 22 overlap when viewed from the third direction D3.

The third connection conductor 27 is disposed in the insulator layer 6 between the third coil conductor 22 and the fourth coil conductor 23. One electrode layer 11 and one electrode layer 14 are positioned in the insulator layer 6 where the third connection conductor 27 is disposed. The third connection conductor 27 is separated from the electrode layers 11 and 14 positioned in the same layer. The third connection conductor 27 is connected to the other end of the third coil conductor 22 and is connected to one end of the fourth coil conductor 23. The third connection conductor 27 interconnects the third coil conductor 22 and the fourth coil conductor 23.

The fourth coil conductor 23 is positioned in the same layer as one electrode layer 11 and one electrode layer 14. The fourth coil conductor 23 is connected to the electrode layer 14 via a connecting conductor 23*a*. The connecting conductor 23*a* is positioned in the same layer as the fourth coil conductor 23. The other end of the fourth coil conductor 23 is connected to the connecting conductor 23*a*. The connecting conductor 23*a* is connected to the electrode layer 14. The connecting conductor 23*a* interconnects the fourth coil conductor 23 and the electrode layer 14. The fourth coil conductor 23 is separated from the electrode layer 11 positioned in the same layer. In the present embodiment, the fourth coil conductor 23, the connecting conductor 23*a*, and the electrode layer 14 are integrally formed.

The first coil conductor 20, the second coil conductor 21, the third coil conductor 22, and the fourth coil conductor 23 are electrically connected through the first connection conductor 25, the second connection conductor 26, and the third connection conductor 27. The first coil conductor 20, the second coil conductor 21, the third coil conductor 22, and the fourth coil conductor 23 constitute the coil 8. The coil 8 is electrically connected to the terminal electrode 4 through the connecting conductor 20*a*. The coil 8 is electrically connected to the terminal electrode 5 through the connecting conductor 23*a*.

The first coil conductor 20, the second coil conductor 21, the third coil conductor 22, the fourth coil conductor 23, the connecting conductors 20*a* and 23*a*, the first connection conductor 25, the second connection conductor 26, and the third connection conductor 27 contain a conductive material. The conductive material contains Ag or Pd. The first coil conductor 20, the second coil conductor 21, the third coil conductor 22, the fourth coil conductor 23, the connecting conductors 20*a* and 23*a*, the first connection conductor 25, the second connection conductor 26, and the third connection conductor 27 are configured as a sintered body of conductive paste containing conductive material powder. Examples of the conductive material powder include Ag powder and Pd powder.

In the present embodiment, the first coil conductor 20, the second coil conductor 21, the third coil conductor 22, the fourth coil conductor 23, the connecting conductors 20*a* and 23*a*, the first connection conductor 25, the second connection conductor 26, and the third connection conductor 27 contain the same conductive material as each of the terminal electrodes 4 and 5. The first coil conductor 20, the second coil conductor 21, the third coil conductor 22, the fourth coil conductor 23, the connecting conductors 20*a* and 23*a*, the first connection conductor 25, the second connection conductor 26, and the third connection conductor 27 may contain a conductive material different from the conductive material of each of the terminal electrodes 4 and 5.

The first coil conductor 20, the second coil conductor 21, the third coil conductor 22, the fourth coil conductor 23, the connecting conductors 20*a* and 23*a*, the first connection conductor 25, the second connection conductor 26, and the third connection conductor 27 are provided in a defect portion formed in the insulator layer 6 that corresponds. The first coil conductor 20, the second coil conductor 21, the third coil conductor 22, the fourth coil conductor 23, the connecting conductors 20*a* and 23*a*, the first connection conductor 25, the second connection conductor 26, and the third connection conductor 27 are formed by conductive paste positioned in a defect portion formed in a green sheet being fired. The green sheet and the conductive paste are fired at the same time as described above. Accordingly, the first coil conductor 20, the second coil conductor 21, the third coil conductor 22, the fourth coil conductor 23, the connecting conductors 20*a* and 23*a*, the first connection conductor 25, the second connection conductor 26, and the third connection conductor 27 are obtained from the conductive paste when the insulator layer 6 is obtained from the green sheet.

The defect portion formed in the green sheet is formed by, for example, the following process. First, a green sheet is formed by element paste containing the constituent material of the insulator layer 6 and a photosensitive material being applied onto a base material. The base material is, for example, a PET film. The photosensitive material contained in the element paste may be either a negative photosensitive material or a positive photosensitive material and a known photosensitive material can be used. Next, the green sheet is exposed and developed by a photolithography method by means of a mask corresponding to the defect portion, and then the defect portion is formed in the green sheet on the base material. The green sheet in which the defect portion is formed is an element pattern.

The electrode layers 10, 11, and 12, the electrode layers 13, 14, and 15, the first coil conductor 20, the second coil conductor 21, the third coil conductor 22, the fourth coil conductor 23, the connecting conductors 20*a* and 23*a*, the first connection conductor 25, the second connection conductor 26, and the third connection conductor 27 are formed by, for example, the following process.

First, a conductive material layer is formed by conductive paste containing a photosensitive material being applied onto a base material. The photosensitive material contained in the conductive paste may be either a negative photosensitive material or a positive photosensitive material and a known photosensitive material can be used. Next, the conductive material layer is exposed and developed by a photolithography method by means of a mask corresponding to the defect portion, and then a conductor pattern corresponding to the shape of the defect portion is formed on the base material.

The multilayer coil component 1 is obtained by, for example, the following process subsequent to the process described above. A sheet in which the element pattern and the conductor pattern are in the same layer is prepared by the conductor pattern being combined with the defect portion of the element pattern. A predetermined number of the sheets are prepared, a stacked body is obtained by the sheets being stacked, heat treatment is performed on the stacked body, and then a plurality of green chips are obtained from the stacked body. In this process, a green stacked body is cut into chips by means of a cutting machine or the like. As a result, a plurality of green chips having a predetermined size can be obtained. Next, the green chips are fired. The multilayer coil component 1 is obtained as a result of the firing. The terminal electrodes 4 and 5 and the coil 8 are integrally formed in the multilayer coil component 1.

As illustrated in FIG. 3, the terminal electrode 4 and a part of the coil 8 overlap when viewed from the third direction D3. Specifically, the second electrode part 4*b* and the third electrode part 4*c* of the terminal electrode 4 and the coil 8 overlap. Likewise, the terminal electrode 5 and a part of the coil 8 overlap when viewed from the third direction D3. Specifically, the second electrode part 5*b* and the third electrode part 5*c* of the terminal electrode 5 and the coil 8 overlap.

Figure 4:
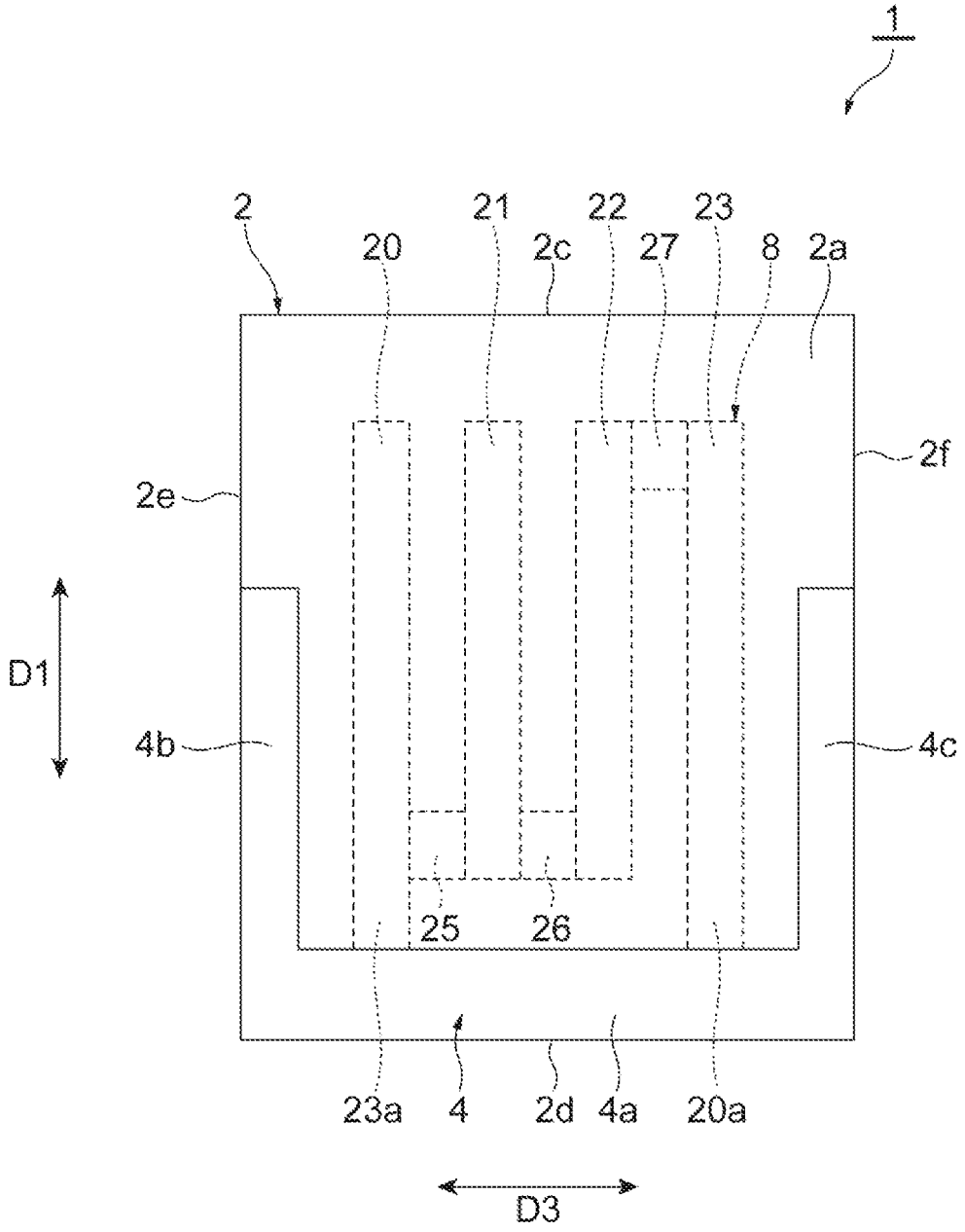
FIG. 4 is a diagram illustrating the configuration of the terminal electrode and the coil.

As illustrated in FIG. 4, the terminal electrode 4 and the coil 8 do not overlap when viewed from the second direction D2. Specifically, the first electrode part 4*a*, the second electrode part 4*b*, and the third electrode part 4*c* of the terminal electrode 4 and the coil 8 do not overlap. Likewise, the terminal electrode 5 and the coil 8 do not overlap when viewed from the second direction D2. Specifically, the first electrode part 5*a*, the second electrode part 5*b*, and the third electrode part 5*c* of the terminal electrode 5 and the coil 8 do not overlap.

As illustrated in FIG. 3, the terminal electrode 4 and the terminal electrode 5 do not overlap the region inside an inner edge 8*a* of the coil 8 when viewed from the third direction D3. Specifically, the second electrode part 4*b* and the third electrode part 4*c* of the terminal electrode 4 and the region inside the inner edge 8*a* of the coil 8 do not overlap. The second electrode part 5*b* and the third electrode part 5*c* of the terminal electrode 5 do not overlap the region inside the inner edge 8*a* of the coil 8. In other words, the terminal electrode 4 and the terminal electrode 5 are not positioned in the region defined by the inner edge 8*a* of the coil 8. In the present embodiment, a distance L1 between the third electrode part 4*c* (second electrode part 4*b*) of the terminal electrode 4 and the third electrode part 5*c* (second electrode part 5*b*) of the terminal electrode 5 in the second direction D2 is equal to or less than a distance L2 of the inner edge 8*a* of the coil 8.

As described above, in the multilayer coil component 1 according to the present embodiment, the terminal electrode 4 and the terminal electrode 5 are embedded in the element body 2. Accordingly, the terminal electrode 4 and the terminal electrode 5 fit within the outer shape of the element body 2 and do not protrude from the outer surface of the element body 2. Accordingly, the multilayer coil component 1 can be reduced in size. In this configuration, in the multilayer coil component 1, each of the terminal electrode 4 and the terminal electrode 5 and at least a part of the coil 8 overlap when viewed from the third direction D3. As a result, in the multilayer coil component 1, the inner diameter of the coil 8 can be increased, and thus the Q value can be improved. Accordingly, characteristics can be improved in the multilayer coil component 1. In addition, in the multilayer coil component 1, each of the terminal electrode 4 and the terminal electrode 5 and the coil 8 do not overlap when viewed from the second direction D2. As a result, in the multilayer coil component 1, the stray capacitance that is generated between each of the terminal electrode 4 and the terminal electrode 5 and the coil 8 can be reduced. As a result, characteristics can be improved in the multilayer coil component 1.

In the multilayer coil component 1 according to the present embodiment, the terminal electrode 4 and the terminal electrode 5 have the first electrode parts 4*a* and 5*a* disposed on the main surface 2*d* (mounting surface) and the second electrode parts 4*b* and 5*b* and the third electrode parts 4*c* and 5*c* disposed on the end surfaces 2*a* and 2*b* and disposed so as to be separated in the third direction D3, respectively. In this configuration, solder is formed at the first electrode parts 4*a* and 5*a*, the second electrode parts 4*b* and 5*b*, and the third electrode parts 4*c* and 5*c* when the multilayer coil component 1 is mounted on, for example, a circuit board. Accordingly, the multilayer coil component 1 and the circuit board can be firmly fixed. In addition, since the solder is formed at the second electrode parts 4*b* and 5*b* and the third electrode parts 4*c* and 5*c*, it can be visually confirmed that the solder is reliably formed.

In the multilayer coil component 1 according to the present embodiment, one end portion of the coil 8 is connected to the first electrode part 4*a* in the terminal electrode 4 and the other end portion of the coil 8 is connected to the first electrode part 5*a* in the terminal electrode 5. The element body 2 where the coil 8 having the coil axis AX extending along the third direction D3 is disposed is configured by the plurality of insulator layers 6 where coil conductors are formed being stacked in the third direction D3. In this configuration, the coil 8 has end portions respectively connected to the first electrode parts 4*a* and 5*a* of the terminal electrode 4 and the terminal electrode 5. In other words, in the multilayer coil component 1, the first and fourth coil conductors 20 and 23 and the connecting conductors 20*a* and 23*a* interconnecting the terminal electrodes 4 and 5 and the coil 8 are formed in the same insulator layer 6. Accordingly, it is possible to prevent disconnection between the terminal electrodes 4 and 5 and the coil 8 even in the case of peeling of the insulator layer 6, and thus it is possible to maintain electrical connection between the terminal electrodes 4 and 5 and the coil 8.

In the multilayer coil component 1 according to the present embodiment, the second electrode parts 4*b* and 5*b* are disposed over the end surfaces 2*a* and 2*b* and one side surface 2*e* and the third electrode parts 4*c* and 5*c* are disposed over the end surfaces 2*a* and 2*b* and the other side surface 2*f*. In this configuration, it is possible to increase the distance between the second electrode parts 4*b* and 5*b* and the third electrode parts 4*c* and 5*c* in the third direction D3. As a result, in the multilayer coil component 1, a region in the element body 2 can be ensured, and thus it is possible to increase the number of turns of the coil 8 while maintaining the size of the element body 2 (multilayer coil component 1). Accordingly, characteristics can be improved in the multilayer coil component 1.

In the multilayer coil component 1 according to the present embodiment, each of the terminal electrode 4 and the terminal electrode 5 does not overlap the region inside the inner edge 8*a* of the coil 8 when viewed from the third direction D3. In this configuration, it is possible to suppress the magnetic flux flow of the coil 8 being hindered by the terminal electrode 4 and the terminal electrode 5. Accordingly, a deterioration in characteristics can be suppressed in the multilayer coil component 1.

Second Embodiment

Figure 5:
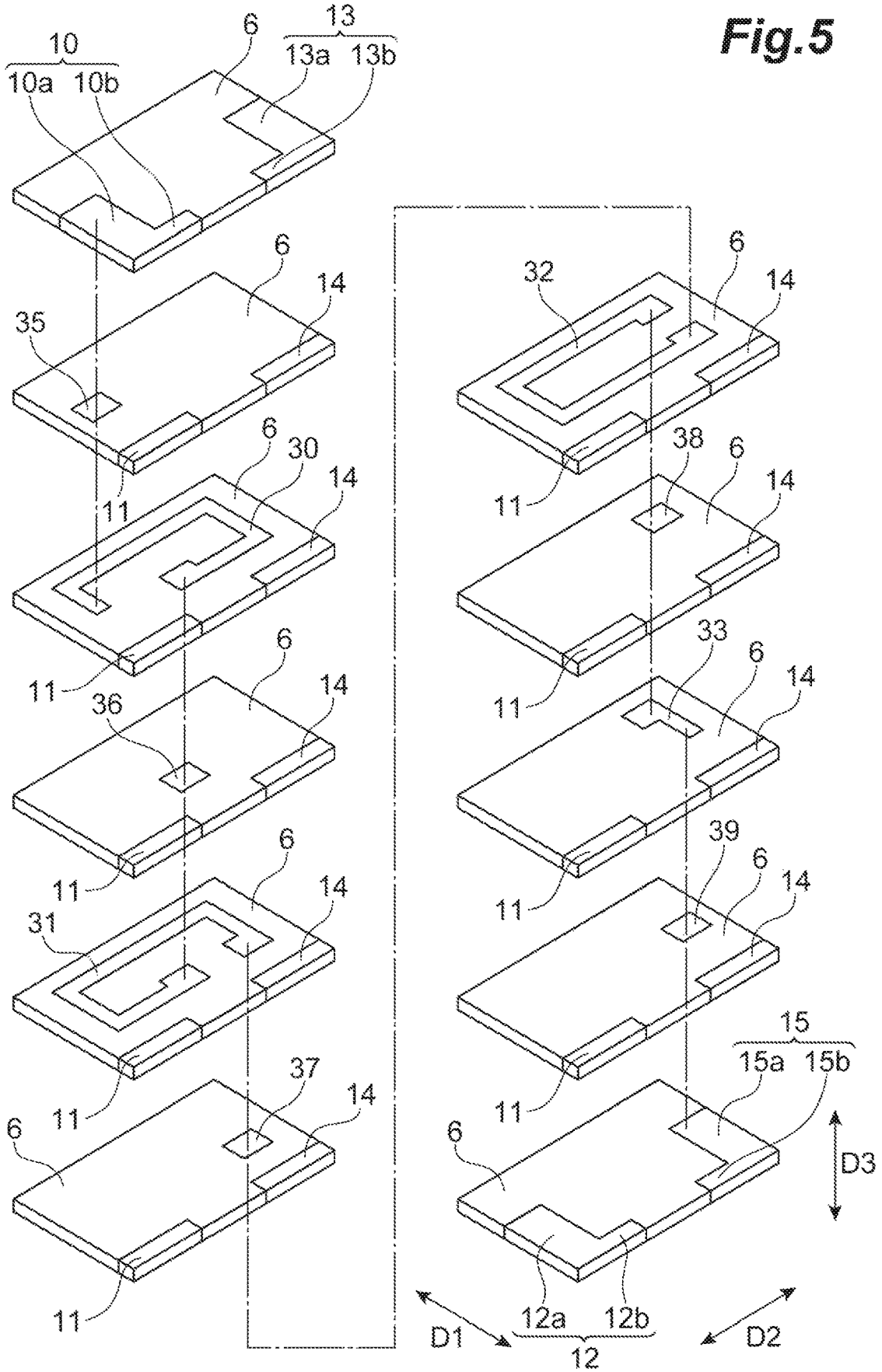
FIG. 5 is an exploded perspective view illustrating the configuration of an element body and a coil conductor of a multilayer coil component according to a second embodiment.
Figure 6:
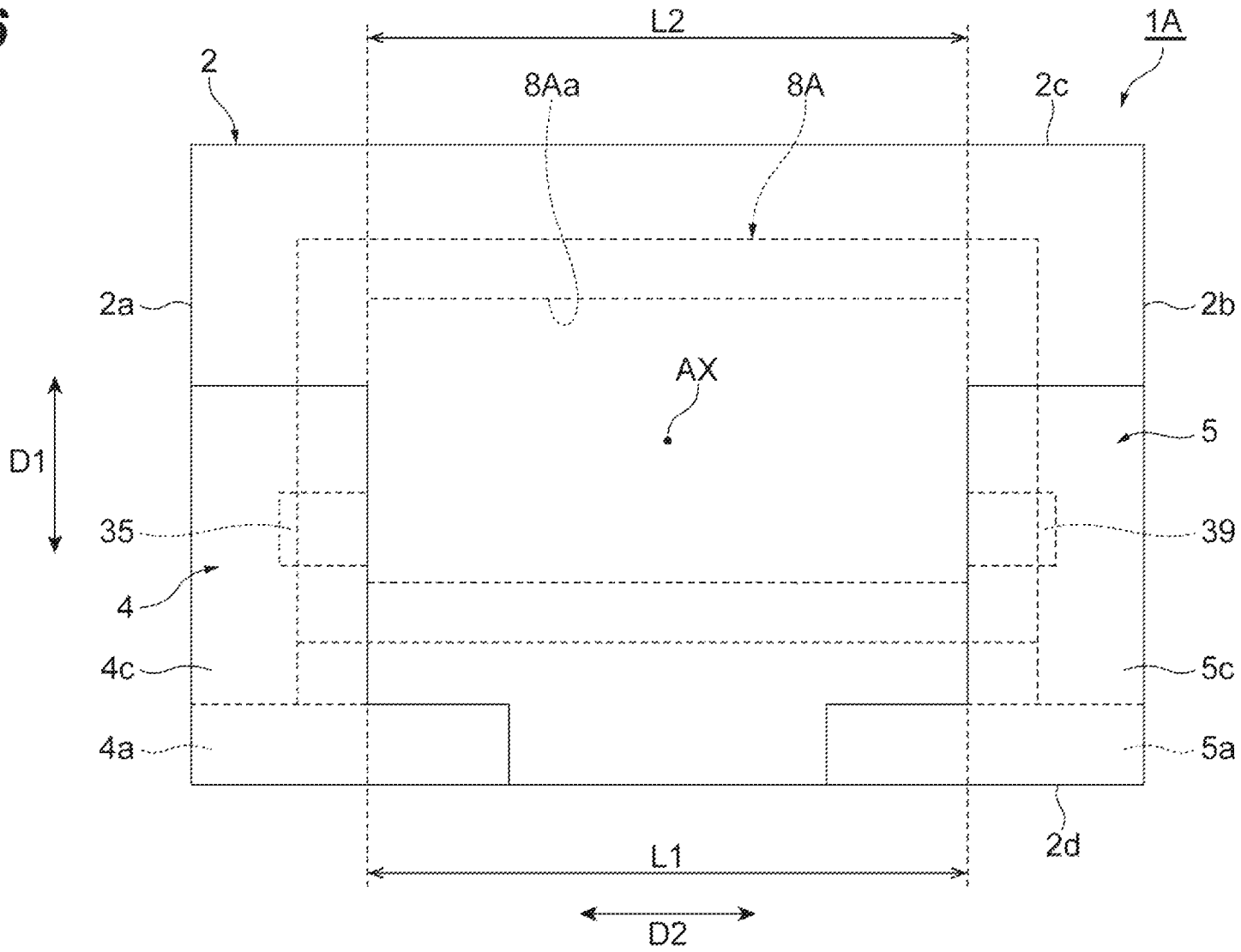
FIG. 6 is a diagram illustrating the configuration of a terminal electrode and a coil.

Next, a second embodiment will be described. As illustrated in FIGS. 5 and 6, a multilayer coil component 1A is provided with a coil 8A disposed in the element body 2. The configuration of the coil 8A of the multilayer coil component 1A is different from the configuration of the coil 8 of the multilayer coil component 1. The multilayer coil component 1A is the same as the multilayer coil component 1 except for the configuration of the coil 8A.

As illustrated in FIG. 5, the coil 8A has a first coil conductor 30, a second coil conductor 31, a third coil conductor 32, and a fourth coil conductor 33. The first coil conductor 30, the second coil conductor 31, the third coil conductor 32, and the fourth coil conductor 33 are disposed along the third direction D3 in the order of the first coil conductor 30, the second coil conductor 31, the third coil conductor 32, and the fourth coil conductor 33. The first coil conductor 30, the second coil conductor 31, the third coil conductor 32, and the fourth coil conductor 33 substantially have a shape in which a part of a loop is interrupted and have one end and the other end. The first coil conductor 30, the second coil conductor 31, the third coil conductor 32, and the fourth coil conductor 33 have a part linearly extending along the first direction D1 and a part linearly extending along the second direction D2. The first coil conductor 30, the second coil conductor 31, the third coil conductor 32, and the fourth coil conductor 33 have a predetermined width.

The coil 8A has a first connection conductor 35, a second connection conductor 36, a third connection conductor 37, a fourth connection conductor 38, and a fifth connection conductor 39. The first connection conductor 35, the second connection conductor 36, the third connection conductor 37, the fourth connection conductor 38, and the fifth connection conductor 39 are disposed along the third direction D3 in the order of the first connection conductor 35, the second connection conductor 36, the third connection conductor 37, the fourth connection conductor 38, and the fifth connection conductor 39. The first connection conductor 35, the second connection conductor 36, the third connection conductor 37, the fourth connection conductor 38, and the fifth connection conductor 39 have a rectangular shape.

The first connection conductor 35 is disposed in the insulator layer 6 between the electrode layer 10 and the first coil conductor 20. One electrode layer 11 and one electrode layer 14 are positioned in the insulator layer 6 where the first connection conductor 35 is disposed. The first connection conductor 35 is separated from the electrode layers 11 and 14 positioned in the same layer. The first connection conductor 35 is connected to the layer part 10*a* of the electrode layer 10 and is connected to one end of the first coil conductor 30. The first connection conductor 35 interconnects the terminal electrode 4 and the first coil conductor 30.

The first coil conductor 30 is positioned in the same layer as one electrode layer 11 and one electrode layer 14. The first coil conductor 30 is separated from the electrode layers 11 and 14 positioned in the same layer. The first coil conductor 30 is separated from the electrode layers 11 and 14 positioned in the same layer.

The second connection conductor 36 is disposed in the insulator layer 6 between the first coil conductor 30 and the second coil conductor 31. One electrode layer 11 and one electrode layer 14 are positioned in the insulator layer 6 where the second connection conductor 36 is disposed. The second connection conductor 36 is separated from the electrode layers 11 and 14 positioned in the same layer. The second connection conductor 36 is connected to the other end of the first coil conductor 30 and is connected to one end of the second coil conductor 31. The second connection conductor 36 interconnects the first coil conductor 30 and the second coil conductor 31.

The second coil conductor 31 is positioned in the same layer as one electrode layer 11 and one electrode layer 14. The second coil conductor 31 is separated from the electrode layers 11 and 14 positioned in the same layer. The first coil conductor 30 and the second coil conductor 31 are adjacent to each other in the third direction D3 in a state where the insulator layer 6 is interposed between the first coil conductor 30 and the second coil conductor 31. The other end of the first coil conductor 30 and one end of the second coil conductor 31 overlap when viewed from the third direction D3.

The third connection conductor 37 is disposed in the insulator layer 6 between the second coil conductor 31 and the third coil conductor 32. One electrode layer 11 and one electrode layer 14 are positioned in the insulator layer 6 where the third connection conductor 37 is disposed. The third connection conductor 37 is separated from the electrode layers 11 and 14 positioned in the same layer. The third connection conductor 37 is connected to the other end of the second coil conductor 31 and is connected to one end of the third coil conductor 32. The third connection conductor 37 interconnects the second coil conductor 31 and the third coil conductor 32.

The third coil conductor 32 is positioned in the same layer as one electrode layer 11 and one electrode layer 14. The third coil conductor 32 is separated from the electrode layers 11 and 14 positioned in the same layer. The second coil conductor 31 and the third coil conductor 32 are adjacent to each other in the third direction D3 in a state where the insulator layer 6 is interposed between the second coil conductor 31 and the third coil conductor 32. The other end of the second coil conductor 31 and one end of the third coil conductor 32 overlap when viewed from the third direction D3.

The fourth connection conductor 38 is disposed in the insulator layer 6 between the third coil conductor 32 and the fourth coil conductor 33. One electrode layer 11 and one electrode layer 14 are positioned in the insulator layer 6 where the fourth connection conductor 38 is disposed. The fourth connection conductor 38 is separated from the electrode layers 11 and 14 positioned in the same layer. The fourth connection conductor 38 is connected to the other end of the third coil conductor 32 and is connected to one end of the fourth coil conductor 33. The fourth connection conductor 38 interconnects the third coil conductor 32 and the fourth coil conductor 33.

The fourth coil conductor 33 is positioned in the same layer as one electrode layer 11 and one electrode layer 14. The fourth coil conductor 23 is separated from the electrode layers 11 and 14 positioned in the same layer.

The fifth connection conductor 39 is disposed in the insulator layer 6 between the electrode layer 15 and the fourth coil conductor 23. One electrode layer 11 and one electrode layer 14 are positioned in the insulator layer 6 where the fifth connection conductor 39 is disposed. The fifth connection conductor 39 is separated from the electrode layers 11 and 14 positioned in the same layer. The fifth connection conductor 39 is connected to the layer part 15*a* of the electrode layer 15 and is connected to the other end of the fourth coil conductor 33. The fifth connection conductor 39 interconnects the terminal electrode 5 and the fourth coil conductor 33.

The first coil conductor 30, the second coil conductor 31, the third coil conductor 32, and the fourth coil conductor 33 are electrically connected through the first connection conductor 35, the second connection conductor 36, the third connection conductor 37, the fourth connection conductor 38, and the fifth connection conductor 39. The first coil conductor 30, the second coil conductor 31, the third coil conductor 32, and the fourth coil conductor 33 constitute the coil 8A.

As illustrated in FIG. 6, the terminal electrode 4 and a part of the coil 8A overlap when viewed from the third direction D3. Specifically, the second electrode part 4*b* and the third electrode part 4*c* of the terminal electrode 4 and the coil 8A overlap. Likewise, the terminal electrode 5 and a part of the coil 8A overlap when viewed from the third direction D3. Specifically, the second electrode part 5*b* and the third electrode part 5*c* of the terminal electrode 5 and the coil 8A overlap.

Figure 7:
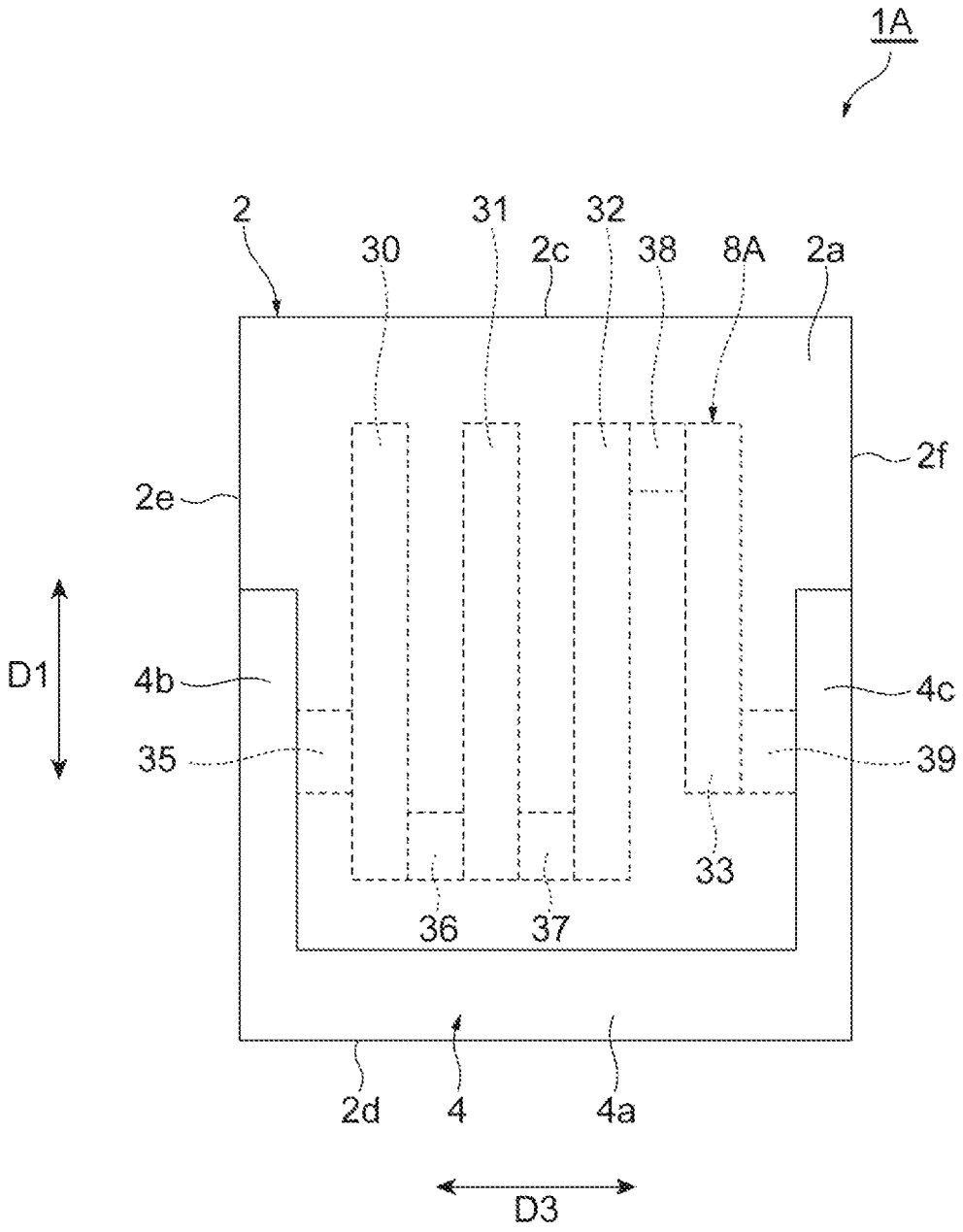
FIG. 7 is a diagram illustrating the configuration of the terminal electrode and the coil.

As illustrated in FIG. 7, the terminal electrode 4 and the coil 8A do not overlap when viewed from the second direction D2. Specifically, the first electrode part 4*a*, the second electrode part 4*b*, and the third electrode part 4*c* of a terminal electrode 4A and the coil 8A do not overlap. Likewise, the terminal electrode 5 and the coil 8A do not overlap when viewed from the second direction D2. Specifically, the first electrode part 5*a*, the second electrode part 5*b*, and the third electrode part 5*c* of the terminal electrode 5 and the coil 8A do not overlap.

As illustrated in FIG. 6, the terminal electrode 4 and the terminal electrode 5 do not overlap the region inside an inner edge 8Aa of the coil 8A when viewed from the third direction D3. Specifically, the second electrode part 4*b* and the third electrode part 4*c* of the terminal electrode 4 and the region inside the inner edge 8Aa of the coil 8A do not overlap. The second electrode part 5*b* and the third electrode part 5*c* of the terminal electrode 5 do not overlap the region inside the inner edge 8Aa of the coil 8A. In other words, the terminal electrode 4 and the terminal electrode 5 are not positioned in the region defined by the inner edge 8Aa of the coil 8A. In the present embodiment, the distance L1 between the third electrode part 4*c* (second electrode part 4*b*) of the terminal electrode 4 and the third electrode part 5*c* (second electrode part 5*b*) of the terminal electrode 5 in the second direction D2 is equal to or less than the distance L2 of the inner edge 8Aa of the coil 8A.

In the multilayer coil component 1A according to the present embodiment, each of the terminal electrode 4 and the terminal electrode 5 and at least a part of the coil 8A overlap when viewed from the third direction D3. As a result, in the multilayer coil component 1A, the inner diameter of the coil 8A can be increased, and thus the Q value can be improved.

Accordingly, characteristics can be improved in the multilayer coil component 1A. In addition, in the multilayer coil component 1A, each of the terminal electrode 4 and the terminal electrode 5 and the coil 8A do not overlap when viewed from the second direction D2. As a result, in the multilayer coil component 1A, the stray capacitance that is generated between each of the terminal electrode 4 and the terminal electrode 5 and the coil 8A can be reduced. As a result, characteristics can be improved in the multilayer coil component 1A.

Although embodiments of the present invention have been described above, the present invention is not necessarily limited to the embodiments described above and various modifications can be made within the scope of the present invention.

Described as an example in the embodiment is a form in which the second electrode parts 4*b* and 5*b* of the terminal electrode 4 and the terminal electrode 5 are disposed on the side surface 2*e* and the third electrode parts 4*c* and 5*c* are disposed on the side surface 2*f*. However, the shapes of the terminal electrode 4 and the terminal electrode 5 are not limited thereto.

Figure 8B:
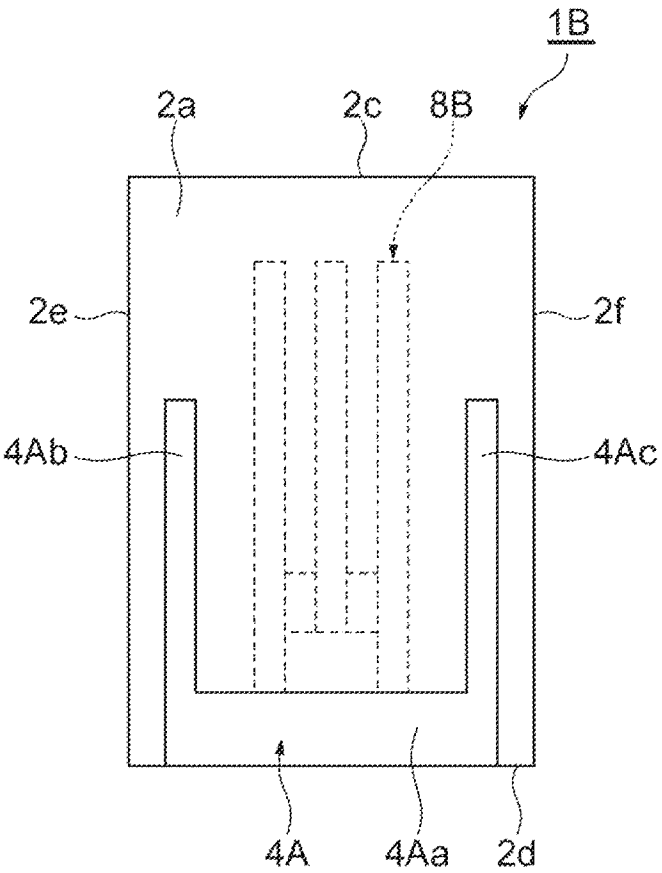
FIG. 8B is a diagram illustrating the configuration of a terminal electrode and a coil of a multilayer coil component according to another embodiment.
Figure 8A:
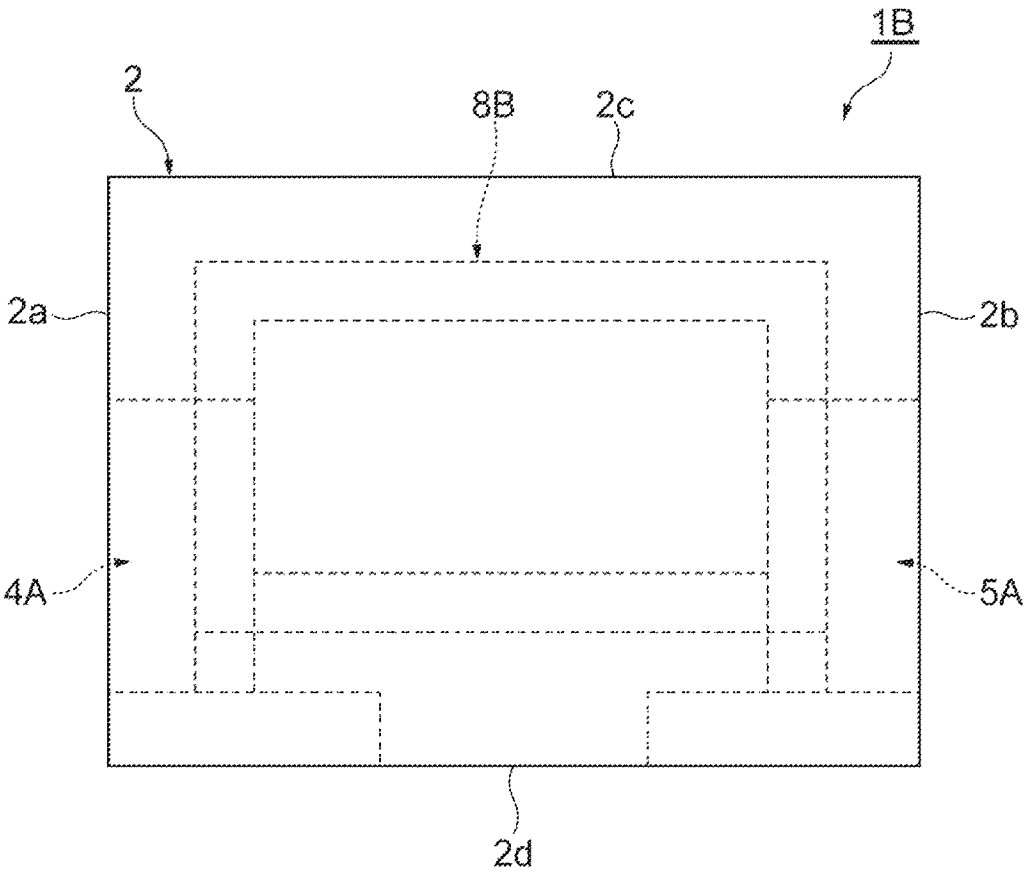
FIG. 8A is a diagram illustrating the configuration of a terminal electrode and a coil of a multilayer coil component according to another embodiment.

As illustrated in FIGS. 8A and 8B, a multilayer coil component 1B is provided with the terminal electrode 4A and a terminal electrode 5A. The terminal electrode 4A has a first electrode part 4Aa, a second electrode part 4Ab, and a third electrode part 4Ac. Likewise, the terminal electrode 5A has a first electrode part, a second electrode part, and a third electrode part. The second electrode part 4Ab and the third electrode part 4Ac of the terminal electrode 4A are disposed on the end surface 2*a*. The second electrode part 4Ab and the third electrode part 4Ac are not disposed on the side surfaces 2*e* and 2*f*. Likewise, the second electrode part and the third electrode part of the terminal electrode 5A are disposed on the end surface 2*b*. The second electrode part and the third electrode part of the terminal electrode 5A are not disposed on the side surfaces 2*e* and 2*f*.

Also in the multilayer coil component 1B, each of the terminal electrode 4A and the terminal electrode 5A and at least a part of a coil 8B overlap when viewed from the third direction D3. As a result, in the multilayer coil component 1B, the inner diameter of the coil 8B can be increased, and thus the Q value can be improved. Accordingly, characteristics can be improved in the multilayer coil component 1B. In addition, in the multilayer coil component 1B, each of the terminal electrode 4A and the terminal electrode 5A and the coil 8B do not overlap when viewed from the second direction D2. As a result, in the multilayer coil component 1B, the stray capacitance that is generated between each of the terminal electrode 4A and the terminal electrode 5A and the coil 8B can be reduced. As a result, characteristics can be improved in the multilayer coil component 1B.

In addition, in the multilayer coil component 1B, the second electrode part 4Ab and the third electrode part 4Ac of the terminal electrode 4A and the second electrode part and the third electrode part of the terminal electrode 5A are disposed only on the end surfaces 2*a* and 2*b*. Accordingly, in the multilayer coil component 1B, peeling of the terminal electrode 4A and the terminal electrode 5A from the element body 2 can be suppressed.

Figure 9:
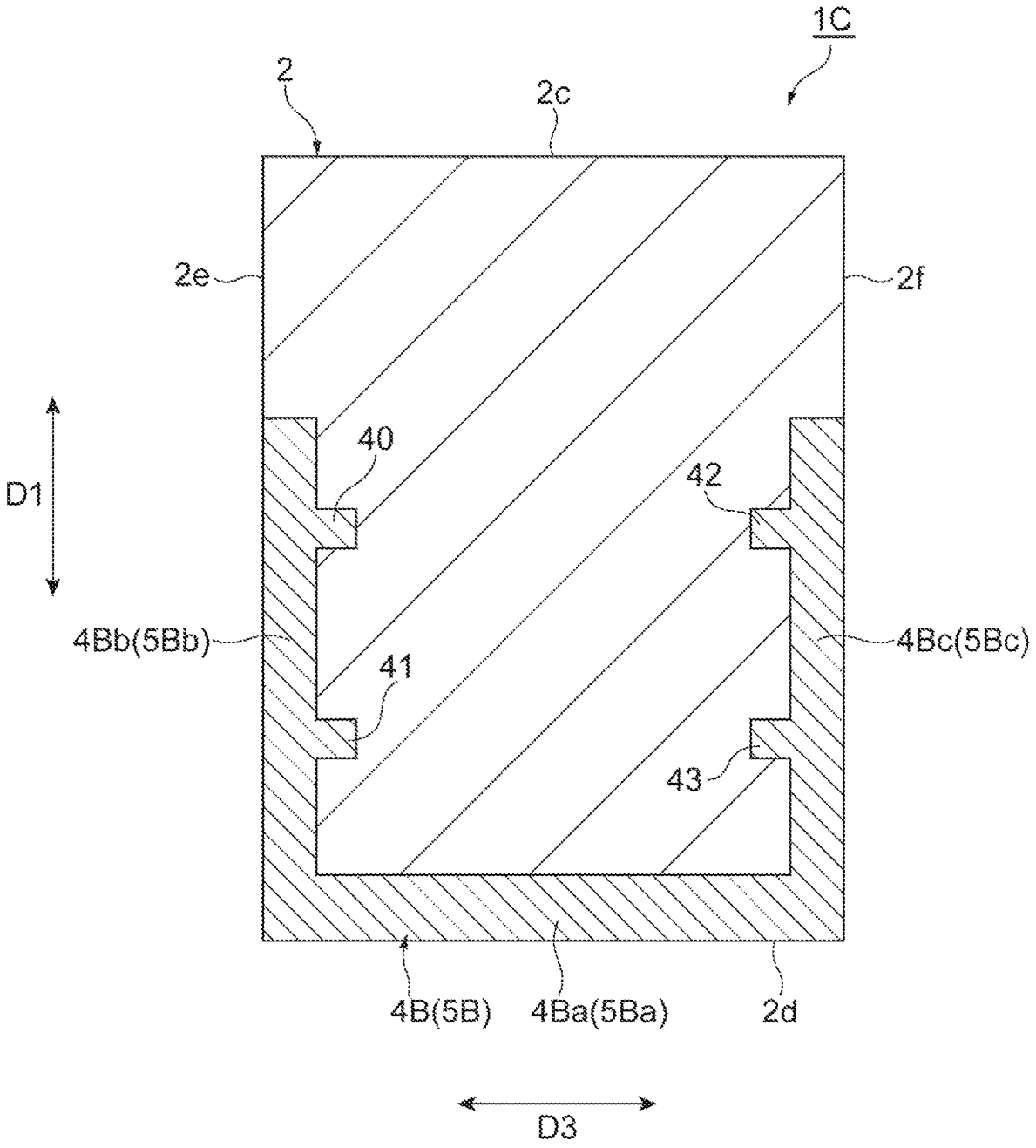
FIG. 9 is a diagram illustrating a cross-sectional configuration of a multilayer coil component according to another embodiment.

In addition to the embodiments described above and as illustrated in FIG. 9, a terminal electrode 4B (5B) of a multilayer coil component 1C is provided with a first electrode part 4Ba (5Ba), a second electrode part 4Bb (5Bb), and a third electrode part 4Bc (5Bc). Hereinafter, the terminal electrode 4B will be described as an example.

The terminal electrode 4B is provided with protruding portions 40, 41, 42, and 43. The protruding portions 40 and 41 protrude from an inner surface 4*d* of the second electrode part 4Bb of the terminal electrode 4B. The protruding portions 42 and 43 protrude from an inner surface 4*e* of the third electrode part 4Bc of the terminal electrode 4B. The inner surface 4*d* and the inner surface 4*e* are surfaces in the element body 2 that face each other in the third direction D3. The protruding portions 40, 41, 42, and 43 are, for example, columnar or prismatic.

The protruding portion 40 and the protruding portion 41 are disposed at a predetermined interval in the first direction D1. Likewise, the protruding portion 42 and the protruding portion 43 are disposed at a predetermined interval in the first direction D1. The number of protruding portions provided at each of the second electrode part 4Bb and the third electrode part 4Bc may be one or more (three or more). In addition, a connection portion connected to the protruding portion 41 may be further provided. It is preferable that the connection portion is disposed at a position shifted from the protruding portion 41 when viewed from the third direction D3. Likewise, the other protruding portions 41, 42, and 43 may be provided with connection portions.

In the multilayer coil component 1B, the second electrode part 4Bb (5Bb) and the third electrode part 4Bc (5Bc) are respectively provided with the protruding portions 40, 41, 42, and 43 and the protruding portions 40, 41, 42, and 43 respectively protrude from the inner surfaces 4*d* and 4*e* in the element body 2 facing each other in the third direction D3. In this configuration, the second electrode part 4Bb (5Bb) and the third electrode part 4Bc (5Bc) and the element body 2 can be firmly fixed. Accordingly, peeling of the terminal electrode 4B and the terminal electrode 5B from the element body 2 can be suppressed. Accordingly, reliability can be improved in the multilayer coil component 1B.

Described as an example in the embodiment is a form in which the coil 8 has the first coil conductor 20, the second coil conductor 21, the third coil conductor 22, the fourth coil conductor 23, the connecting conductors 20*a* and 23*a*, the first connection conductor 25, the second connection conductor 26, and the third connection conductor 27. However, each conductor constituting the coil 8 is not limited in number to the value described above. The same applies to the coils 8A and 8B.

Described as an example in the embodiment is a form in which a magnetic material or a nonmagnetic material constitutes the insulator layer 6. Alternatively, a resin material or the like may constitute the insulator layer 6. In this configuration, the material constituting each conductor of the coils 8, 8A, and 8B may be Cu or the like.

What is claimed is:

1. A multilayer coil component comprising:

an element body formed by a plurality of insulator layers being stacked and including a pair of end surfaces facing each other, a pair of main surfaces facing each other, and a pair of side surfaces facing each other, one of the main surfaces being a mounting surface;

a coil disposed in the element body and having a coil axis extending along a coil direction parallel to a facing direction of the pair of side surfaces; and a first terminal electrode and a second terminal electrode disposed apart from each other in a facing direction of the pair of end surfaces and embedded in the element body, the first terminal electrode having a first component that is rectangular in shape when viewed along the coil direction, the second terminal electrode having a second component that is rectangular in shape when viewed along the coil direction, the first component and the second component being at a distance away from each other when viewed along the coil direction, wherein each of the first terminal electrode and the second terminal electrode is disposed over at least a corresponding end surface and the mounting surface, the first component, that is embedded in the element body, and at least a first part of the coil overlap when viewed from the coil direction, the second component, that is embedded in the element body, and at least a second part of the coil overlap when viewed from the coil direction, the first terminal electrode and the coil do not overlap when viewed from the facing direction of the pair of end surfaces, and the second terminal electrode and the coil do not overlap when viewed from the facing direction of the pair of end surfaces.

2. The multilayer coil component according to claim 1, wherein each of the first terminal electrode and the second terminal electrode includes:

a first electrode part disposed on the mounting surface; and a second electrode part and a third electrode part disposed on the end surface and disposed apart from each other in the facing direction of the pair of side surfaces.

3. The multilayer coil component according to claim 2, wherein one end portion of the coil is connected to the first electrode part in the first terminal electrode, and the other end portion of the coil is connected to the first electrode part in the second terminal electrode.

4. The multilayer coil component according to claim 2, wherein the second electrode part is disposed over the end surface and one of the side surfaces, and the third electrode part is disposed over the end surface and the other side surface.

5. The multilayer coil component according to claim 2, wherein each of the second electrode part and the third electrode part is provided with a protruding portion protruding from each of inner surfaces in the element body facing each other in the facing direction of the pair of side surfaces.

6. The multilayer coil component according to claim 1, wherein each of the first terminal electrode and the second terminal electrode does not overlap a region inside an inner edge of the coil when viewed from the facing direction of the pair of side surfaces.

7. A multilayer coil component comprising:

an element body formed by a plurality of insulator layers being stacked and including a pair of end surfaces facing each other, a pair of main surfaces facing each other, and a pair of side surfaces facing each other, one of the main surfaces being a mounting surface;

a coil disposed in the element body and having a coil axis extending along a coil direction parallel to a facing direction of the pair of side surfaces; and a first terminal electrode and a second terminal electrode disposed apart from each other in a facing direction of the pair of end surfaces and embedded in the element body, the first terminal electrode having a first component that is rectangular in shape when viewed along the coil direction, the second terminal electrode having a second component that is rectangular in shape when viewed along the coil direction, the first component and the second component being at a distance away from each other when viewed along the coil direction, wherein each of the first terminal electrode and the second terminal electrode is disposed over at least a corresponding end surface and the mounting surface, the first component and at least a first part of the coil overlap when viewed from the coil direction, the second component and at least a second part of the coil overlap when viewed from the coil direction, the first terminal electrode and the coil do not overlap when viewed from the facing direction of the pair of end surfaces, the second terminal electrode and the coil do not overlap when viewed from the facing direction of the pair of end surfaces, each of the first terminal electrode and the second terminal electrode includes:

a first electrode part disposed on the mounting surface and having a first height in the facing direction of the pair of main surfaces and a first width in the facing direction of the pair of side surfaces; and a second electrode part and a third electrode part disposed on the corresponding end surface and disposed apart from each other in the facing direction of the pair of side surfaces, the second electrode part having a second height in the facing direction of the pair of main surfaces and a second width in the facing direction of the pair of side surfaces, the third electrode part having a third height in the facing direction of the pair of main surfaces and a third width in the facing direction of the pair of side surfaces, the first width is greater than the second width and the third width, and the second height and the third height are greater than the first height.

8. The multilayer coil component according to claim 7, wherein one end portion of the coil is connected to the first electrode part in the first terminal electrode, and the other end portion of the coil is connected to the first electrode part in the second terminal electrode.

9. The multilayer coil component according to claim 7, wherein the second electrode part is disposed over the end surface and one of the side surfaces, and the third electrode part is disposed over the end surface and the other side surface.

10. The multilayer coil component according to claim 7, wherein each of the second electrode part and the third electrode part is provided with a protruding portion protruding from each of inner surfaces in the element body facing each other in the facing direction of the pair of side surfaces.

11. The multilayer coil component according to claim 7, wherein each of the first terminal electrode and the second terminal electrode does not overlap a region inside an inner edge of the coil when viewed from the facing direction of the pair of side surfaces.

12. The multilayer coil component according to claim 1, wherein each of the first terminal electrode and the second terminal electrode forms a rectangular shape when viewed in a facing direction of the pair of main surfaces.

13. The multilayer coil component according to claim 7, wherein each of the first terminal electrode and the second terminal electrode forms a rectangular shape when viewed in a facing direction of the pair of main surfaces.

14. A multilayer coil component comprising:

an element body formed by a plurality of insulator layers being stacked in a stacking direction and including a pair of end surfaces facing each other, a pair of main surfaces facing each other, and a pair of side surfaces facing each other, one of the main surfaces being a mounting surface;

a coil disposed in the element body and having a coil axis extending along a coil direction parallel to a facing direction of the pair of side surfaces, the facing direction of the pair of side surfaces being parallel to the stacking direction; and a first terminal electrode and a second terminal electrode disposed apart from each other in a facing direction of the pair of end surfaces and embedded in the element body, the first terminal electrode having a first component that is rectangular in shape when viewed along the coil direction, the second terminal electrode having a second component that is rectangular in shape when viewed along the coil direction, the first component and the second component being at a distance away from each other when viewed along the coil direction, wherein each of the first terminal electrode and the second terminal electrode is disposed over at least a corresponding end surface and the mounting surface, the first component, that is embedded in the element body, and at least a first part of the coil overlap when viewed from the coil direction, the second component, that is embedded in the element body, and at least a second part of the coil overlap when viewed from the coil direction, the first terminal electrode and the coil do not overlap when viewed from the facing direction of the pair of end surfaces, the second terminal electrode and the coil do not overlap when viewed from the facing direction of the pair of end surfaces, and when viewed from the facing direction of the pair of side surfaces, an area occupied by the first terminal electrode includes a first portion and a second portion, the first portion extending closer to the second terminal electrode than the second portion;

an area occupied by the second terminal electrode includes a third portion and a fourth portion, the third portion extending closer to the first terminal electrode than the fourth portion;

the second portion overlaps with a first area occupied by the part of the coil;

the fourth portion overlaps with a second area occupied by the part of the coil; and none of the first portion and the third portion overlaps with the area occupied by the part of the coil.

* * * * *